United States Patent [19]

Verhoeven

[11] Patent Number: 4,775,329

[45] Date of Patent: Oct. 4, 1988

[54] BRANCH CONNECTOR FOR COAXIAL CABLE

[75] Inventor: Laurentius M. Verhoeven, RV Veghel, Netherlands

[73] Assignee: E. I. Du Pont de Nemours and Company, Wilmington, Del.

[21] Appl. No.: 63,531

[22] Filed: Jun. 18, 1987

[51] Int. Cl.[4] ..... H01R 4/24

[52] U.S. Cl. ..... 439/394; 439/583

[58] Field of Search ..... 439/394, 578, 582, 583

[56] References Cited

U.S. PATENT DOCUMENTS

| | | | |
|---|---|---|---|
| 2,694,182 | 11/1954 | Edlen et al. | 333/6 |
| 2,706,282 | 4/1955 | Dudra | 439/394 |
| 4,437,722 | 3/1984 | Bianchi | 439/394 |

FOREIGN PATENT DOCUMENTS

| | | |
|---|---|---|
| 3340943 | 11/1983 | Fed. Rep. of Germany . |
| 888213 | 2/1959 | United Kingdom . |
| 2082850 | 8/1980 | United Kingdom . |

*Primary Examiner*—Joseph H. McGlynn

[57] ABSTRACT

A branch connector for coaxial cable comprising a cylindrical housing of electrically conductive material and a supporting disc of insulation material inserted therein. The cylindrical housing has at least one tooth adapted to penetrate and electrically contact the outer conductor of a coaxial cable received in a feed-through channel of the housing. The supporting disc has a projecting pin adapted to penetrate and electrically contact the inner conductor of the coaxial cable. A clamping element with a screwed sleeve fits over the cylindrical housing. A screw cap couples with the sleeve.

14 Claims, 5 Drawing Sheets

BRANCH CONNECTOR FOR COAXIAL CABLE

BACKGROUND OF THE INVENTION

The invention relates to an electrical connector and, more particularly, to a branch connector for a coaxial cable with at least one outer and one inner conductor.

Due to the great increase in the use of microcomputers, home computers, word processing equipment and their accompanying visual display terminals, printer units, memory equipment, etc., it is often necessary for the transfer of information between the various users in practice to have a local connection network by means of which this equipment can be interconnected. In office environments in particular it is often necessary for the connection of equipment to have the possibility of branching off this connection network at any desired point.

A large number of units can be interconnected by means of coaxial cable and for that purpose have suitable coaxial junction boxes. These local interconnection networks are therefore largely built up of coaxial cable.

In the current networks, the equipment is generally connected by means of terminal boxes. This means a T-shaped interconnection element which is provided with coaxial junction boxes, to each end of which a coaxial cable is connected by means of a coaxial plug. This manner of connection is fairly expensive for building up a local connection network and it is not possible with it to make branches in a cable in use without interrupting the stream of information flowing through it.

With a branch connector such as disclosed in U.S. Pat. No. 2,694,182 granted Nov. 9, 1954 to Edlen et al., branching of a cable in use can be achieved, but this requires three successive operations. First, the coaxial cable to be branched must be confined in the feed through channel by means of a cover connected hingedly to the housing of the branch connector, and this cover must be locked by means of a screw. During this operation, the outer conductor of the coaxial cable to be branched is contacted. The penetration pin for contacting the inner conductor of the coaxial cable to be branched can then be screwed into the housing. Finally, one end of the coaxial cable to be connected must be preworked in such a way that the insulating outer sheath and the outer conductor are removed over a length round the insulating inner sheath and the inner sheath must be removed over a shorter length round the Inner conductor This is a fairly time-consuming exercise, in which there is a great risk of undesirable damage to the cable to be connected. This preworked end must subsequently be brought into contact in clamped fashion with the housing and the penetration pin.

SUMMARY OF THE INVENTION

In view of the above-described disadvantages the object of the invention is to produce a branch connector in which coaxial cables can be branched in a rapid and simple manner without special preworking of the ends of the cable. The branch connector according to the invention is characterized in that the housing is cylindrical in shape, at one end of which the feed-through channel is provided, the penetration pin is locked axially inside the housing on a transverse supporting disc of insulating material in such a way that the sharp point, transversely to the feed-through channel, projects therein while the clamping element consists of a screwed sleeve to be fitted over the housing, with a corresponding feed through channel and a screw cap to be coupled thereto.

In the branch connector disclosed by the above noted U.S. Pat. No. 2,694,182, during the screwing-in of the penetration pin after the cable to be branched is confined in the housing, a situation arises where the pin is connected directly to the conducting housing by means of the outer conductor of the coaxial cable confined in the feed-through channel and the at least one tooth. If there is improper use of the branch connector, i.e., if the cable to be connected is already connected to the penetration pin before it is screwed into the housing as a result of this short circuit situation, when the cable to be connected is already in use, depending on the type of impedance adaptation, undesirable phenomena such as short circuit currents, strong reflections and the like can occur, with a great risk of loss of information, distortion thereof or damage to the equipment. Such a situation can also occur if the housing, for example as the result of damage, has to be replaced without the fastening to the penetration pin of the cable to be connected needing to be replaced. In this case, a short circuit situation will arise even if the penetration pin is unscrewed from the housing before the branched cable is removed from the feed-through channel.

In order to avoid such short circuit situations, the branch connector according to the invention, in which at least one tooth runs in the same direction as the penetration pin, is further characterized in that at least one tooth projects under the conducting point of the penetration pin into the feed-through channel.

In this way, on contacting of the cable to be confined in the feed-through channel, at least one tooth cannot make contact with the outer conductor of the cable until the conducting point of the penetration pin is completely inside the insulating inner sheath of the cable, as a result of which a direct connection is not possible between the point and the tooth via the outer conductor of the coaxial cable.

A preferred embodiment of the invention is characterized in that the feed-through channel is formed by two approximately U-shaped notches lying opposite each other in the cylinder jacket of the housing and accessible from one end of the housing, on at least one narrow edge of which notches at least one tooth is provided.

By connection together of the screwed sleeve and the screw cap, a force is exerted radially on the coaxial cable fitted in the feed-through channel. Under the influence of the screw force, the penetration pin and at least one tooth successively penetrate into the cable for contacting the inner and the outer conductor respectively. In order to obtain An evenly distributed force on the cable for avoidance as far as possible of deformation of the cable during contacting, according to a preferred embodiment of the invention, provision is made concentrically inside the screw cap for a tubular pressure element which fits into the housing and of which one closed end face coincides with the open end of the screw cap. Provision is also made inside the screwed sleeve for an approximately U-shaped supporting surface provided with openings for feeding through the penetration pin and at least one tooth, said supporting surface together with U-=shaped notches in the screw-threaded end of the screwed sleeve forming the corresponding feed-through channel for accommodation of the coaxial cable.

In the contacted state, the penetration pin may make contact by means of its conducting point only with the inner conductor of the coaxial cable. In order to avoid faulty contacts as much as possible, one must also prevent the penetration pin from moving in axial and/or radial direction inside the housing. According to the preferred embodiment of the invention, the penetration pin is for that purpose attached to a carrier strip on which the insulating material of the transverse supporting disc grips for the purpose of preventing axial and radial shifting of the penetration pin the supporting disc, and the end which is to penetrate into the cable is enclosed over a part by the insulating material of the supporting disc in order to prevent electrical contact with the outer conductor of the contacted coaxial cable.

In order to prevent the possibility of the supporting disc itself being displaced inside the housing in the axial and tangential direction during contacting, the branch connector according to the invention is provided with locking means, which in the preferred embodiment of the branch connector consist of at least one boss which projects radially outwards on the periphery of the supporting disc and can engage in at least one opening provided in the jacket of the housing.

By designing the other end of the penetration pin as a contact socket or contact pin, one forms together with the other end of the cylindrical housing either a coaxial coupling socket or a coaxial plug for connecting in a simple manner the cable or equipment to be connected, in contrast to the above noted U.S. patent. It will be clear that the branch connector designed in this way according to the invention can also advantageously be used as the end connector for a coaxial cable.

If a branch with a plug connection is not desired or necessary, for example if an additional coaxial cable has to be used between the branch point and the equipment for connection, a further embodiment of the branch connector according to the invention is characterized in that at the other end of the housing a second feed-through channel of the same type with at least one tooth is provided and the other end of the penetration pin is also designed as a sharp conducting point, through which a second coaxial cable with a second clamping element of the same type can be confined in the second feed-through channel and contacted.

BRIEF DESCRIPTION OF THE DRAWINGS

The invention will now be explained in greater detail with reference to the preferred embodiments shown in the drawings.

Figure 4:
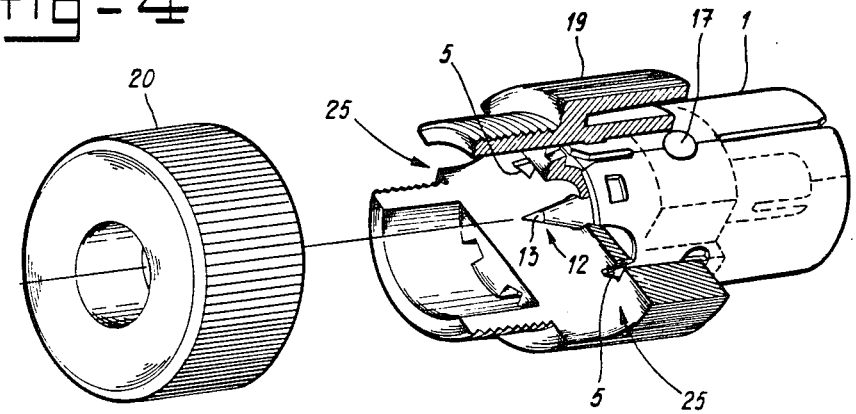
FIG. 4 is a perspective view with cut-away parts of the preferred embodiment of the branch connector according to FIG. 3 in which part of the clamping element is fitted over the housing.
Figure 7:
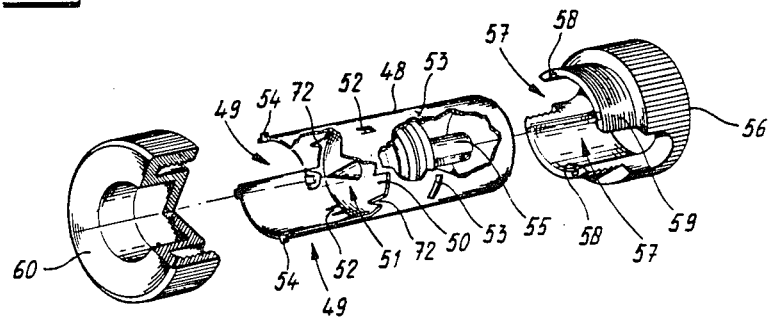
Figure 10:
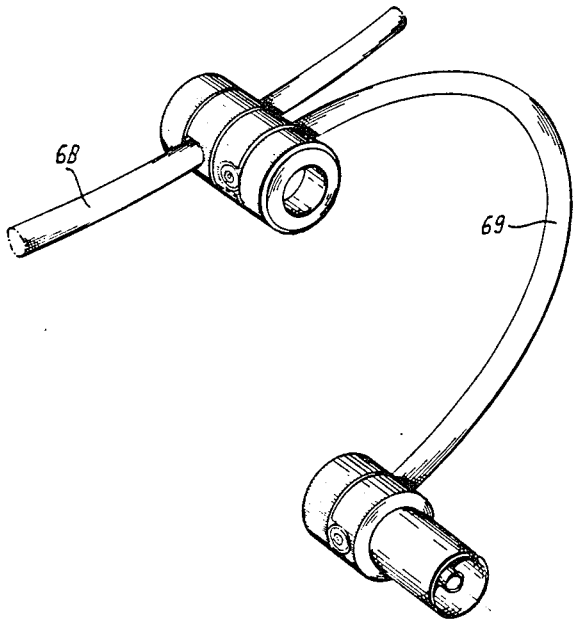
Figures 8, 9:
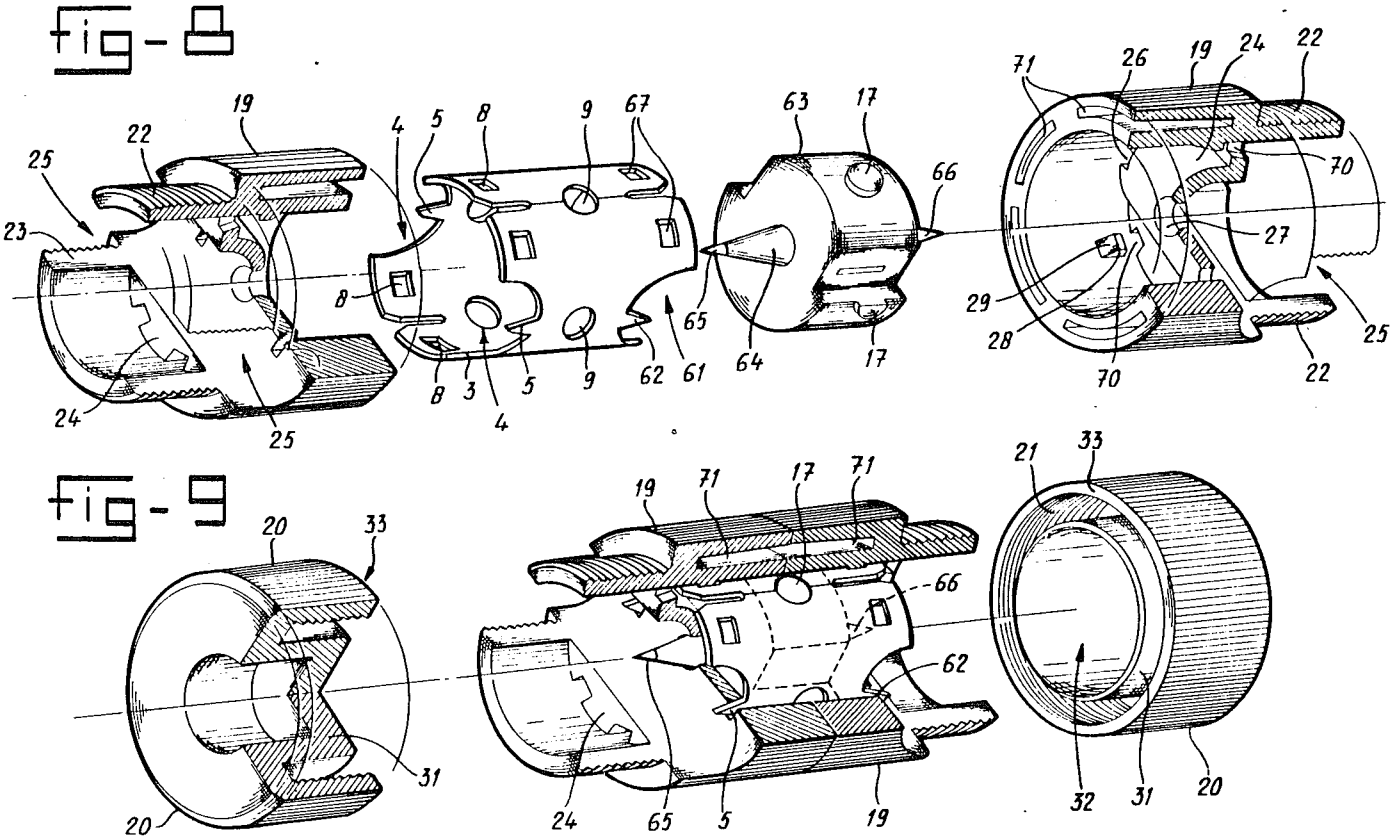

FIGS. *6a–6d* illustrate in various stages and coaxial cable views the structure of the penetration pin and the supporting disc according to the preferred embodiment of the present invention;

FIG. 7 shows another embodiment of a branch connector according to the present invention;

FIG. 8 is a perspective view with disassembled and cut-away parts of another preferred embodiment of the branch connector according to the invention for contacting of two coaxial cables;

FIG. 9 is a perspective view with cut-away parts of the preferred embodiment of the branch connector according to FIG. 8 in the partially fitted state; and FIG. 10 shows a branching of a coaxial cable be means of branch connectors according to FIG. 4 and FIG. 9.

DESCRIPTION OF THE PREFERRED EMBODIMENTS

Figure 1:
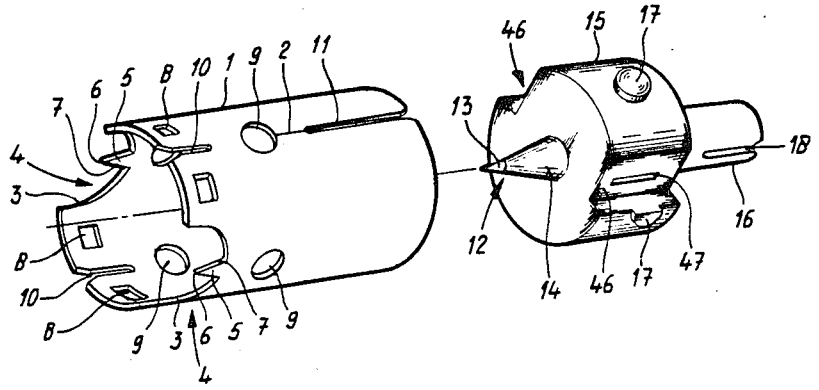
FIG. 1 is a perspective view of a preferred embodiment of the housing with disassembled parts and the penetration pin of the branch connector according to the invention.

The preferred embodiment of the branch connector according to the invention illustrated in FIG. 1 shows a cylindrical housing 1 of spring-loaded electrically conducting material with a longitudinal seam 2. This longitudinal seam is closed under the influence of the spring force of the housing itself. Formed at one end of the housing by U-shaped notches 3 is a feed-through channel 4 running through in the radial direction. Formed at the base of each U-shaped notch is a tooth 5 which projects into the feed-through channel and has a pointed end 6 and sharp edges 7. The housing 1 is provided along its periphery with circular rows of openings 8 and 9 which Are displaced relative to each other in the longitudinal direction. From the two ends of the housing, provision is made in the longitudinal direction thereof for several slits 10 and 11, which preferably coincide with the longitudinal seam 2 as shown in FIG. 1. The slits are widened over a length at the ends of the housing.

The penetration pin 12 of electrically conducting material to be fitted in the housing 1 is provided at the end penetrating into the coaxial cable to be contacted, with a sharply tapering conducting point 13 in such a way that this point together with the through-running insulation material 14 conically tapering round the pin of the transverse supporting disc 15 forms an externally smooth surface. In the embodiment shown in FIG. 1, the other end of the penetration pin is designed as a socket 16 with at least one slit 18 in the longitudinal direction thereof.

Figure 2:
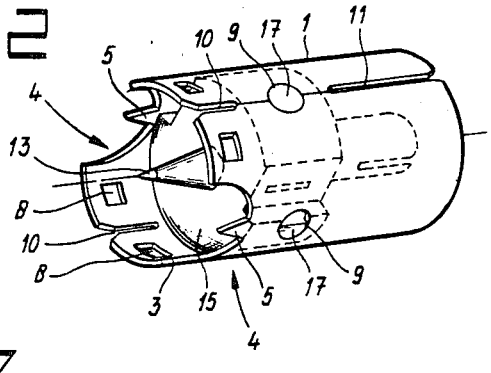
FIG. 2 is a perspective view of the housing of the branch connector according to FIG. 1 with the penetration pin fitted therein partially shown by dotted lines.

The penetration pin with the supporting disc fitted around it is subsequently fitted therein, overcoming the spring force of the housing in such a way that the radially outward projecting bosses 17 of the supporting disc engage with the openings 9 of the housing which correspond thereto as regards shape and dimensions as shown in FIG. 2. The openings 9 and the projecting bosses 17 are provided in such a way that after fitting of the penetration pin in the housing the conducting point 13 as a whole projects further outwards into the feed-through channel 4 than the teeth 5.

It will be clear that the spring force of the material of the housing has to have such strength that on the one hand the supporting disc can be fitted easily by hand and on the other, the supporting disc is locked by means of the bosses 17 engaging in the openings 9 against axial and tangential displacement through forces acting thereon during normal use of the branch connector. Although the bosses 17 and the openings 9 are designed as circular in shape, it will be clear that other shapes (rectangular, square, etc.) can also be used.

As can be seen clearly from FIG. 2, the socket 16 together with the end of the housing not provided with a feed-through channel forms a coaxial coupling socket. It will be clear that instead of being designed as a socket the end of the penetration pin can also be designed as a contact pin as a result of which a coaxial plug is formed (not shown). A coaxial cable contacted by the penetration pin and the teeth of the housing can in this way be connected simply to a coaxial junction box of a piece of equipment to be connected. By means of the slits 11, 18, tolerance differences occurring can be overcome in a simple manner.

Figure 3:
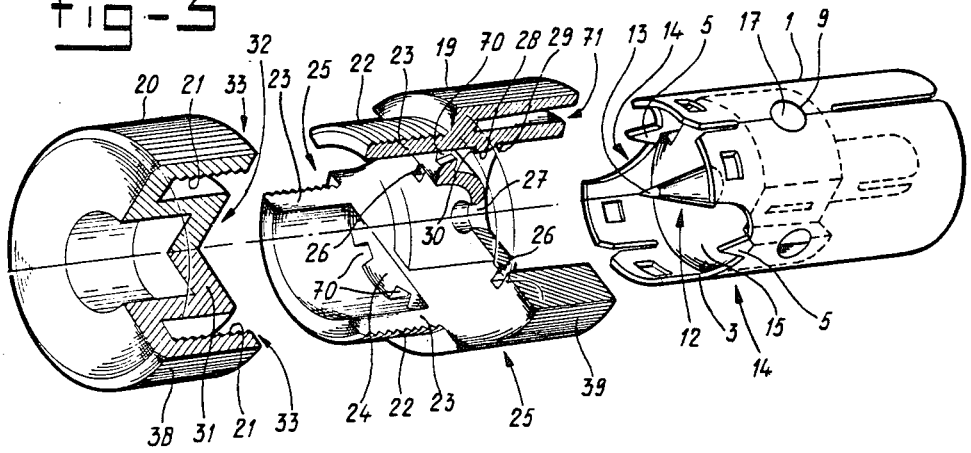
FIG. 3 is a perspective view with disassembled and cut-away parts of a preferred embodiment of a clamping element of the branch connector according to the invention together with the fitted branch connector from FIG. 2.

FIG. 3 shows in perspective the fitted branch connector of FIG. 2 and a preferred embodiment of the clamping element according to the invention in which a part thereof is cut-away for the purpose of showing clearly the internal layout of the clamping element. Shown on the left of the mounted housing are the two separate parts of the clamping element for confining the in feed-through channel the coaxial cable to be contacted, namely the screwed sleeve 19 and the screw cap 20. The internal diameter of the screwed sleeve is slightly larger than the external diameter of the housing. The screw cap 20 contains internal screw thread 21 which can mate with the external screw thread 22 of the screwed sleeve 19. At the end provided with screw thread, the screwed sleeve has a corresponding feed-through channel 25 which is formed by U-shaped notches 23 and an approximately U-shaped supporting surface 24 for accommodation and through-feed of the coaxial cable to be contacted. In the supporting surface 24, along the periphery, are openings 26 and in the centre thereof an opening 27 through which after the screwed sleeve is fitted over the housing the teeth 5 and the penetration pin 12 project into the corresponding feed-through channel 25.

Formed on the inside at the end of the screwed sleeve which is not provided with screw thread are radially projecting trapezoidal bosses 28, of which one slanting side 29 rests against the open end of the screwed sleeve and of which the other straight side 30 is adjacent to the convex side of the supporting surface 24. Only one of such trapezoidal bosses 28 can be seen in the drawing in FIG. 3.

These trapezoidal bosses 28 can mate with rectangular openings 8 provided in the jacket of the housing along the periphery thereof in such a way that when the screwed sleeve is fitted from the end of the housing provided with the feed-through channel the bosses 28 engage with the openings 8 as shown in FIG. 4. Through the straight side 30 of the respective trapezoidal bosses 28 and the convex side of the supporting surface 24 the fitted screwed sleeve is prevented from being displaced in the longitudinal direction of the housing under the effect of the forces acting thereon during normal use. The relative placing and dimensions of the trapezoidal pins 28 and the openings 8 in the housing are chosen in such a way that the screwed sleeve can be locked to the housing only in that position in which the feed-through channels 4 and 25 of the housing and the screwed sleeve respectively lie opposite each other. The convex side of the supporting surface 24 and the U-shaped notches 3 of the housing have such dimensions that the convex part of the supporting surface fits into these notches. Together with the trapezoidal bosses 28, this in an effective manner prevents the screwed sleeve from turning in the tangential direction as a result of the screw cap being screwed on the screwed sleeve.

The projecting bosses 17 on the supporting disc 15 and the accompanying openings 9 in the housing 1 are chosen in a different shape compared with the projecting bosses 28 of the screwed sleeve 19 and the accompanying openings 8 in order to prevent the penetration pin from being fitted wrongly into the housng through the projecting bosses 17 engaging in the openings 8.

The openings 70 along the periphery of the supporting surface 24 are produced for manufacturing reasons during the formation of the trapezoidal bosses 28. The grooves 71 in the wall of the screwed sleeve 19 serve purely to save material.

The screw cap contains a pressure element 31 which fits concentrically in tubular form in the interior of the screwed sleeve and whose closed end face 32 coincides with the face bounded by the edge 33 of the open end of the screw cap.

Figure 5:
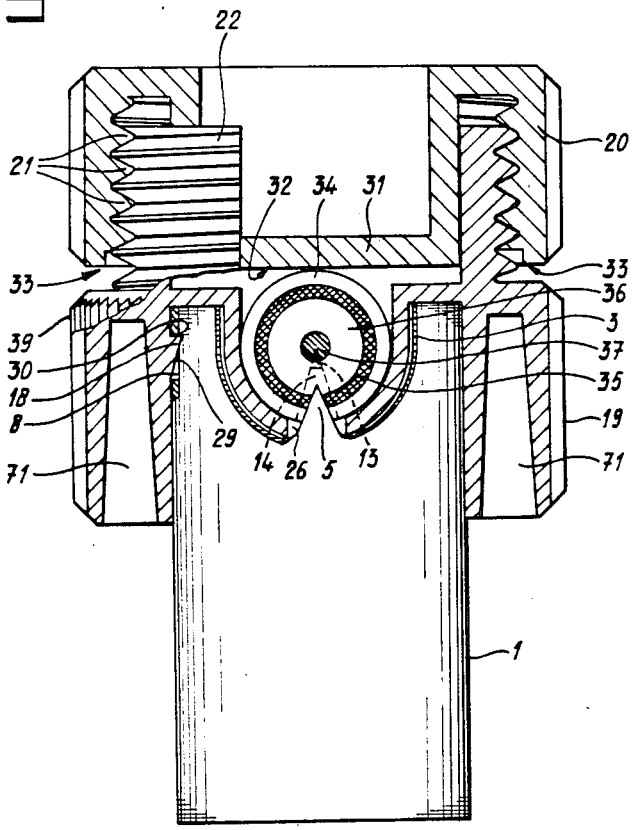
FIG. 5 shows on an enlarged scale with cut-away parts a preferred embodiment of the branch connector according to the invention with a contacted coaxial cable confined therein.
Figure 6A:
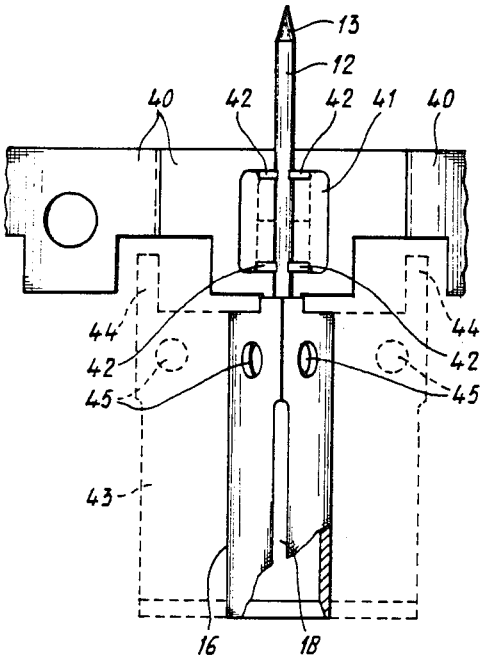
Figure 6C:
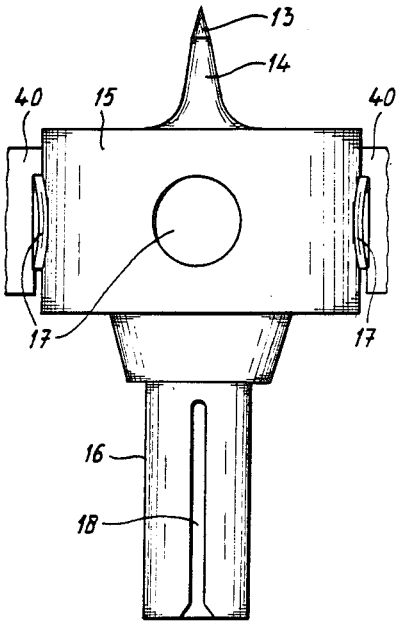
Figure 6B:
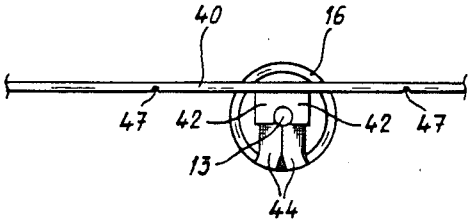
Figure 6D:
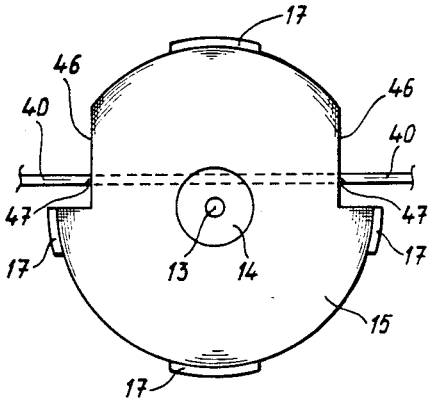

When in the assembly shown in FIG. 4 a coaxial cable is inserted into the corresponding feed-through channel 25 through tightening of the screw cap on the screwed sleeve, the cable can be moved in the longitudinal direction of the housing under the effect of the pressure exerted through the pressure face 32 and the edge 33. First of all here, the conducting point 13 of the penetration pin penetrates into the insulating outer sheath 34 of the coaxial cable shown in FIG. 5. Further tightening of the screw cap results in the point 13 successively penetrating through the outer conductor 35 and the insulating inner sheath 36 to the inner conductor 37 of the coaxial cable. After some time, the teeth 5 also penetrate into the outer sheath, the outer conductor and the inner sheath.

If it is now ensured that the distance between the pointed end 6 of the tooth 5 and the base of the point 13 is greater than the thickness of the outer conductor 35 of the coaxial cable to be contacted, the point 13 and the tooth 5 cannot make contact simultaneously with the outer conductor so that short circuiting of the tooth and the penetration pin is prevented. In the final situation shown in FIG. 5, the cable sits under the influence of the clamping action of the screwed sleeve and the screw cap firmly retained in the feed-through channel 25.

It will be clear that the cable is both contacted and clamped in the feed-through channel in one operation, namely tightening of the screw cap on the screwed sleeve. Through the pressure element 31 and the shape of the feed-through channel 25 corresponding to the round cable and the curved supporting face 24 in the screwed sleeve 19, the cable is prevented from being deformed during the contacting in such a way that the conducting point 13 of the penetration pin does not penetrate radially into the cable and consequently will not make contact with the inner conductor 37 of the cable.

The screwed sleeve and the screw cap are provided with external ridges 38,39 respectively, in order to have sufficient grip for fixing the screw cap on the screwed sleeve by hand. The screw cap and the screwed sleeve can be made of either metal or injection-moulded plastic.

The teth 5 of the housing must be sufficiently rigid to be able to penetrate without deformation through the insulating outer sheath 34 and the outer cnductor 35, generally made up of a braided wire screen and/or a thin copper foil, of the coaxial cable. Making the tip 13 of the penetration pin pointed means that coaxial cables with either a solid inner conductor 37 or an inner conductor 37 consisting of stranded wires can be contacted. Of course, the penetration pin must also have sufficient rigidity to enable it to pass through the cable without deformation.

FIGS. *6a–6d* illustrate how the penetration pin 12, the socket 16 and the supporting disc 15 are connected together in the preferred embodiment of the present invention. In the carrier strip 40 of electrically conducting material, an opening 41 is provided in such a way that lips 42 which are bent from the position shown by the dotted line perpendicular to the plane of the drawing in FIG. *6a* are thereby formed. The electrically conducting penetration pin 12 is clamped between these bent-over lips 42 at a distance from the carrier strip 40. The socket 16, the formation of which is shown by dotted lines as 43 in FIG. *6a*, is fixed with the lips 44, bent inwards perpendicular to the plane of the drawing, on the end opposite the pointed end 13 of the penetration pin around the latter. FIG. *6b* shows the top view of the system thus formed, seen from the point 13 of the penetration pin.

Subsequently by means of, for example, an injection molding process, the supporting disc 15 is formed round the penetration pin and part of the socket 16, as shown in FIG. *6c*. Material of the supporting disc penetrates in the process into the opening 41 of the carrier strip and the holes 45 of the socket, which provides in an efficient manner a barrier against axial shifting of the socket and the penetration pin in the supporting disc. The whole is then separated from the adjacent carrier strips on either side at the level of the side faces 46 which were produced during formation of the supporting disc such that they lie inwards relative to the periphery thereof. The surfaces of fracture of the carrier strip are indicated by 47 (see also FIG. 1). The fact that the surfaces of fracture 47 lie inwards relative to the periphery of the supporting disc means that they are prevented in the mounted state from making electrical contact with the housing.

FIG. 7 shows another partially cut-away embodiment of the branch connector according to the invention. At one end of the cylindrical housing 48, as in the embodiment according to FIG. 1, provision is made for U-shaped notches which form a feed-through channel 49 with projecting teeth 72 therein. The supporting disc 50 with the penetration pin 51 projecting into the feed-through channel 49 is held clamped here between rows, displaced relative to each other in the longitudinal direction of the housing, of spring-loaded lips 52 projecting inwards radially along the periphery thereof and elevations 53. These lips and elevations are formed as bent-through parts of the cylindrical jacket of the housing. At the end of the housing 48 which is provided with the feed-through channel provision is made for short radially outward projecting lips 54. The penetration pin 51 is insulated in the same way as in FIG. 1 at the end, which is to penetrate into the cable and at the other end is provided with a socket 55. The screwed sleeve 56 is cylindrical in shape, with an internal diameter which is slightly larger than the external diameter of the housing 48. The screwed sleeve has at the end provided with the screw thread 59 a corresponding feed-through channel 57, formed by U-shaped notches, but without internal supporting surface 24 as in the embodiment according to FIG. 3. Provided on this same end internally in the longitudinal direction of the screwed sleeve around the periphery thereof are short grooves 58, of such dimensions that the lips 54 of the housing 48 fit into these grooves 58. These lips and grooves work together in such a way that when the screwed sleeve is slid ovr the housing from the end of the housing not provided with the feed-through channel, the screwed sleeve is held and positioned in such a way that the feed-through channels 49 and 57 of the housing 48 and screwed sleeve 56 respectively lie opposite each other and form a feed-through channel which is open for receiving the coaxial cable. The screw cap 60 is the same shape as the screw cap 20 according to the embodiment of FIG. 3, the diameter of the pressure element inside the screw cap 60 being such that the pressure element fits in the interior of the housing 48. A cable inserted in the feed-through channel is contacted in the same way as described in connection with the preferred embodiment of the invention. When the screw cap 60 is screwed onto the screwed sleeve 56, the latter is locked by means of the lips 54 and the grooves 58 against turing in the tangential direction.

Another embodiment of a branch connector according to the invention for contacting two separate coaxial cables is shown in perspective in FIG. 8. The other end of the housing is here also provided with a similar second feed-through channel 61 with tooth 62 and openings 67, as in the case of the branch connector with a single feed-through chanel 4, tooth 5 and opening 8 in FIG. 1. The penetration pin 64 supported by the transverse supporting disc 63 is now formed in such a way that it has two pointed conducting points 65,66 which each project into a feed-through channel at the two ends of the housing. The supporting disc 63 can be locked in the housing in the same way as in the branch connector according to FIG. 1. The screwed sleeves 19 are locked to the housing in the same way as shown in FIG. 4.

A coaxial cable can now be inserted in both feed-through channels 4,61 and is contacted in the same way as that described for the branch connector for a single cable. The fitted assembly of two of the same screwed sleeves 19 with the screw thread ends facing away from each other is shown in FIG. 9.

FIG. 10 shows how a branching can be achieved according to the invention with the branch connector built up in a simple and universal manner. The coaxial cable 68, designed for example as a ring circuit, is branched by means of a branch connector according to FIG. 8, while the cable 69 for connection is provided at the other end with a branch connector according to FIG. 3 or FIG. 7. This end can then be connected to a coaxial junction box of an apparatus to be connected.

It should be understood that the invention is not restricted to the embodiments discussed above and shown in the figures, but that modifications and additions can be provided, for example, in the numbers of teeth, the locking of the penetration pin in the housing or the way in which the separate parts of the clamping element are connected together, for example, instead of screw thread, by means of a "snap connection", etc., without going beyond the scope of the invention.

I claim:

1. A branch connector for a coaxial cable having an outer insulation sheath surrounding at least one outer conductor and an inner insulation sheath between said outer conductor and at least one inner conductor, said connector comprising:

a cylindrical housing of electrically conductive material provided with a feed-through channel at one end for receiving the cable, said housing further being provided at said one end with at least one tooth which projects into said channel and is adapted to pierce the outer insulation sheath and electrically contact the outer conductor of said cable;

a supporting disc of insulation material adapted for insertion into said cylindrical housing, said disc having an electrically conductive penetration pin projecting from said disc into said feed-through channel of the cylindrical housing, said pin being conically tapered and being surrounded by insulation material except at its point, said pin being electrically insulated from said cylindrical housing and adapted to penetrate radially into the cable and electrically contact the inner conductor with its point, the insulation material surrounding the remainder of the pin preventing electrical contact between said pin and the outer conductor of the cable; and a clamping element for retaining the cable in the feed-through channel of the housing, said clamping element having a corresponding feed-through channel aligned with the feed-through channel of the cylindrical housing, said clamping element also including a screwed sleeve adapted to be fitted over the cylindrical housing, and a screw cap for coupling with said screwed sleeve.

2. A branch connector according to claim 1 wherein said tooth projects in substantially the same direction as the penetration pin, said tooth projecting a distance less than the point of the penetration pin into the feed-through channel.

3. A branch connector according to claim 1 wherein the feed-through channel is formed by two approximately U-shaped notches disposed opposite each other in the cylindrical wall of the housing and accessible from one end of the housing, said housing having at least two teeth, one at each notch on a narrow edge thereof.

4. A branch connector according to claim 1, wherein the housing is provided with means for retaining and positioning the screwed sleeve in such a way that the feed-through channel is open for receiving the coaxial cable.

5. A branch connector according to claim 1, wherein a tubular pressure element is provided concentricaly inside the screw cap, said pressure element adapted to fit into screwed sleeve or the housing.

6. A branch connector according to claim 1, wherein the penetration pin is attached to a carrier strip on which the insulating material of the supporting disc grips for the purpose of preventing axial and radial shifting of the penetration pin within the supporting disc.

7. A branch connector according to claim 1, wherein the other end of the penetration pin is designed as a socket and together with the other end of the housing forms a coaxial coupling socket.

8. A branch connector according to claim 1, wherein the other end of the penetration pin is designed as a contact pin, and together with the other end of the housing forms a coaxial plug.

9. A branch connector according to claim 1, further comprising at the other end of the cylindrical housing a second feed-through channel also having at least one tooth, said penetration pin also having at its other end a sharp conducting point, whereby a second coaxial cable can be received in said second feed-through channel and confined by a second clamping element while being electrically contacted by said other end of the penetration pin and the tooth of the second channel.

10. A branch connector according to claim 1, wherein the clamping element is made of plastic.

11. A branch connector according to claim 1, wherein an approximately U-shaped supporting surface is provided inside the screwed sleeve, said U-shaped supporting surface having openings for feeding through the penetration pin and said one tooth, said supporting surface together with U-shaped notches in the screw-threaded end of the screwed sleeve forming the corresponding feed-through channel.

12. A branch connector according to claim 11, wherein one projecting trapezoidal boss is provided internally along the periphery of the screwed sleeve between an end thereof not provided with a screw thread and a convex side of the supporting surfaces along the periphery, said trapezoidal boss being adapted to engage with at least one opening provided at the end of the housing provided with the feed-through channel.

13. A branch connector according to claim 1, wherein locking means is provided inside the housing by which the supporting disc is locked against displacement in the axial and tangential direction after the disc is inserted into the housing.

14. A branch connector according to claim 13, wherein the locking means includes at least one boss which projects radially outwards on the periphery of the supporting disc and is adapted to engage an opening provided in the wall of the housing.

* * * * *